US005417551A

United States Patent [19]

Abe et al.

[11] Patent Number: 5,417,551

[45] Date of Patent: May 23, 1995

[54] HOUSING ARRANGEMENT FOR A SYNCHRONOUS PLURAL MOTOR FLUID ROTARY APPARATUS

[75] Inventors: Yoshikazu Abe, Neyagawa; Teruo Maruyama, Hirakata; Akira Takara, Higashiosaka; Norio Okutani, Neyagawa, all of Japan

[73] Assignee: Matsushita Electric Industrial Co., Ltd., Osaka, Japan

[21] Appl. No.: 210,631

[22] Filed: Mar. 18, 1994

Related U.S. Application Data

[63] Continuation of Ser. No. 11,312, Jan. 29, 1993, abandoned.

[30] Foreign Application Priority Data

Jan. 31, 1992 [JP] Japan ..... 4-016046

[51] Int. Cl.[6] ..... F04B 39/14

[52] U.S. Cl. ..... 417/203; 417/205; 417/238; 417/423.4; 418/201.1; 415/90

[58] Field of Search ..... 417/199.1, 199.2, 201, 417/203, 205, 238, 259, 360, 423.4, 423.5, 423.12, 423.14, 424.1, 338; 418/201.1, 2; 415/90

[56] References Cited

U.S. PATENT DOCUMENTS

| | | | |
|---|---|---|---|
| 1,433,733 | 10/1922 | Lindsay | 417/238 |
| 3,947,193 | 3/1976 | Maurice | 415/90 |
| 4,025,225 | 5/1977 | Durant | 417/90 |
| 4,375,156 | 3/1983 | Shaw | 418/201.1 |
| 4,797,068 | 1/1989 | Hayakawa et al. | 417/205 |
| 4,904,155 | 2/1990 | Nagaoka et al. | 417/423.4 |
| 5,040,949 | 8/1991 | Crinquette et al. | 417/205 |
| 5,092,740 | 3/1992 | Yamamura | 417/201 |
| 5,118,251 | 6/1992 | Saulgeot | 417/205 |
| 5,165,872 | 11/1992 | Fleischmann et al. | 417/423.4 |
| 5,166,566 | 11/1992 | Bernhardt et al. | 417/423.4 |
| 5,197,861 | 3/1993 | Maruyama et al. | 417/423.4 |
| 5,201,638 | 4/1993 | Bieri | 417/234 |

FOREIGN PATENT DOCUMENTS

| | | | |
|---|---|---|---|
| 195481 | 8/1987 | Japan | 418/2 |
| 200084 | 8/1989 | Japan | 418/2 |

*Primary Examiner*—Richard A. Bertsch
*Assistant Examiner*—Roland G. McAndrews, Jr.
*Attorney, Agent, or Firm*—Wenderoth, Lind & Ponack

[57] ABSTRACT

A fluid rotary apparatus includes rotors accommodated in a housing, driving shafts on which the rotors are mounted, upper and lower bearings for rotatably supporting upper and lower portions of each of the shafts, fluid suction and fluid-discharging openings formed in the housing, motors adapted for independently and synchronously driving each of the shafts, rotation-detecting devices for detecting the rotational angle and/or the number of rotations of each motor, contact-preventing gears for contacting each other before the rotors contact each other, and a positive displacement pump structure section sucking and discharging fluid by utilizing a closed space formed by the rotors and the housing and controlling the motors in synchronous rotation thereof in response to signals outputted from the device. The housing includes, along the axial direction of the shaft, a first section accommodating the rotors, a second section accommodating the gears and the upper bears, a third section accommodating the lower bearings, a fourth section accommodating the motors and a fifth section accommodating the detecting device. The housing sections are capable of being disassembled by fixing members removably fixing the housing sections to each other and sealing members held between the housing sections.

10 Claims, 7 Drawing Sheets

HOUSING ARRANGEMENT FOR A SYNCHRONOUS PLURAL MOTOR FLUID ROTARY APPARATUS

This application is a continuation of now abandoned application, Ser. No. 08/011,312, filed Jan. 29, 1993.

BACKGROUND OF THE INVENTION

The present invention relates to a fluid rotary apparatus, and more particularly to a fluid rotary apparatus suitable for allowing a vacuum pump to generate a vacuum in a wide range of vacuum pressures by discharging gas from a vacuum chamber installed in an apparatus for manufacturing semiconductors.

A vacuum pump for generating a vacuum environment is required by a CVD apparatus, a dry etching apparatus, a sputtering apparatus, an evaporating apparatus and the like for use in processes for manufacturing semiconductors. The vacuum pump is used also in processes of manufacturing magnetic disks and liquid crystal displays.

In recent years, a vacuum pump having a high operational performance has been more and more strongly demanded. In processes for manufacturing semiconductors, it has become desirable for circuits to be more and more highly integrated, for wafers to have larger diameters, for circuits to have large three-dimensional configurations, and for many kinds of semiconductors to be manufactured in small quantities. For high integration, clean equipment is required. Small equipment is necessary to provide wafers with large diameters. The equipment requires complex processing in multiple chambers so that the circuits can be large in three-dimensions. In order to manufacture many kinds of semiconductors in small quantities, equipment must have a network.

In order to comply with the above demands, it is necessary to prevent the vacuum pump from being polluted by oil, that the vacuum pump can generate a wide range of vacuum pressures, that the vacuum pump is corrosion-resistant, and that the vacuum pump has a high efficiency relative to the space it occupies.

Above all, the vacuum pump is required to generate vacuum pressures in a wide range. Although vacuum pressures as low as $10^{-8}$ to $10^{-10}$ torr have been required in recent years, one vacuum pump is incapable of generating such a high vacuum (i.e. low pressure). That is, in a positive displacement vacuum pump called a roughing rotary pump, two rotors synchronously rotate with a screw formed on the peripheral surface of each rotor engaging each other to generate a volume change in a closed space disposed between the screws. Gas is inhaled and compressed repeatedly to discharge the gas from the vacuum chamber by utilizing the volume change. This type of pump is suitable for discharging gas in the region of viscous flow, the pressure of which is near atmospheric pressure, but the pump operates in a pressure range from as high as atmospheric pressure to $10^{-3}$ torr. In a kinetic vacuum pump called a turbo pump, one rotor imparts momentum to gas molecules by its rotation so that the gas molecules are transferred by the momentum. As a result, gas is discharged from the vacuum chamber. The pump provides a vacuum pressure as low as $10^{-2}$ to $10^{-10}$ torr, but in principle, the pump is capable of discharging gas from the vacuum chamber in a molecular flow region, the vacuum pressure of which is lower than $10^{-1}$ torr and higher than $10^{-3}$ torr. In order to obtain a low vacuum pressure of $10^{-8}$ to $10^{-10}$ torr, it is necessary that a vacuum pressure of $10^{-2}$ to $10^{-3}$ torr is generated by the rotary pump such that a predetermined high (i.e. low pressure) vacuum is obtained by the turbo pump.

The use of two types of vacuum pumps leads to the installation of large equipment. That is, in order for equipment to carry out composite processing in multiple chambers, each chamber is required to be equipped with a vacuum apparatus. The use of two types of vacuum pumps for each chamber does not allow a vacuum discharge apparatus to be compact. Consequently, a space cannot be efficiently used and, in addition, the cost of equipment is high.

SUMMARY OF THE INVENTION

It is an object of the present invention to provide a fluid rotary apparatus suitable for allowing a single vacuum pump, accommodated therein, to generate a high vacuum (i.e. low pressure) from atmospheric pressure by discharging gas from a vacuum chamber.

It is another object of the present invention to provide a fluid rotary apparatus which can be assembled and disassembled easily.

In accomplishing these and other objects of the present invention, according to a first aspect of the present invention, there is provided a fluid rotary apparatus comprising a plurality of rotors accommodated in a housing and a plurality of driving shafts on which the rotors are mounted. A plurality of upper and lower bearings rotatably support upper and lower portions of each of the driving shafts. A fluid-suction opening and a fluid-discharging opening are formed at the housing. A plurality of motors are adapted for independently and synchronously driving each of the driving shafts, and a plurality of rotation-detecting means detect the rotational angle and/or the number of rotations of each of the motors. Contact-preventing gears contact each other before the rotors contact each other, and a positive displacement pump structure section is provided for sucking and discharging fluid by utilizing a closed space formed by the rotors and the housing by controlling the motors for synchronous rotation thereof in response to signals outputted from the rotation-detecting means.

The housing comprises, along the axial direction of the driving shaft, a first housing section for accommodating the rotors, a second housing section for accommodating contact-preventing gears and the upper bearings, a third housing section for accommodating the lower bearings, a fourth housing section for accommodating the motors, and a fifth housing section for accommodating the rotation-detecting means. The first through fifth housing sections are capable of being disassembled. Fixing members removably fix the housing sections to each other and sealing members are held between the housing sections adjacent to each other so as to closely be brought into contact with the adjacently assembled housing section.

According to a second aspect of the present invention, there is provided a fluid rotary apparatus comprising a plurality of rotors accommodated in a housing and a plurality of driving shafts on which the rotors are mounted. A plurality of upper and lower bearings rotatably support upper and lower portions of each of the driving shafts. A fluid-suction opening and a fluid discharging opening are formed at the housing. A plurality of motors are adapted for independently and synchronously driving each of the driving shafts. A plurality of rotation-detecting means detect the rotational angle and/or the number of rotations of each of the motors. Contact-preventing gears contact each other before the rotors contact each other. A positive displacement pump structure section is provided for sucking and discharging fluid by utilizing a closed space formed by the rotors and the housing by controlling the motors for the synchronous rotation thereof in response to signals outputted from the rotation-detecting means. A kinetic pump structure section is formed coaxially with at least one of the driving shafts and above the positive displacement pump structure section, and has a rotor for imparting momentum to gas molecules by its rotation so that the gas molecules are transferred by the momentum.

The housing comprises, along the axial direction of the driving shaft, a first housing section for accommodating the rotors, a second housing section for accommodating contact-preventing gears and the upper bearings, a third housing section for accommodating the lower bearings, a fourth housing section for accommodating the motors and a fifth housing section for accommodating the rotation-detecting means. The first through fifth housing sections are capable of being disassembled. A sixth housing section accommodates the kinetic pump structure section. Fixing members removably fix the housing sections to each other and sealing members are held between the housing sections adjacent to each other so as to be closely brought into contact with the adjacently assembled housing section.

According to the above construction, the housing accommodating the rotors, the driving shafts, the motors, the bearings and the other components comprise a plurality of housing sections layered one on the other in the axial direction of the driving shafts. Therefore, the fluid rotary apparatus can be assembled and disassembled very easily, for the reason described below.

That is, in the positive displacement pump structure section, essential components, such as the rotation-detecting encoders, the thrust bearings, the contact-preventing gears, and the rotors are provided along the axial direction of one of the driving shafts parallel with each other. Accordingly, since the housing can be constructed by connecting a plurality of housing sections one on the other in the axial direction of one of the driving shafts, each component mounted on the driving shafts is covered with each housing section. In addition, each component can be disassembled in order from, e.g., the upper section, without damaging the components.

It is necessary that a plurality of driving shafts are assembled with the axes thereof parallel with each other and the interval thereof maintained as designed in the positive displacement pump structure section in order for the positive displacement pump structure section to display its intended performance. To this end, each driving shaft is placed at a predetermined position and each housing section is piled one on the other, with the position of each component adjusted. In this manner, each driving shaft is not displaced from each other and the apparatus can be constructed easily and accurately.

The housing can accommodate the positive displacement pump structure section and the kinetic pump structure section, which can be driven by one of the plurality of driving shafts disposed in the positive displacement pump structure section. Accordingly, one fluid rotary apparatus is capable of generating a high vacuum directly, and further has a simple construction and is compact. The kinetic pump structure section is disposed on the upper end of at least one of the driving shafts, and components such as a rotor are sequentially disposed along the axial direction of one of the driving shafts. Since the kinetic pump structure section is also accommodated in the housing section, this structure section has an operation and advantage similar to those of the positive displacement pump structure section.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
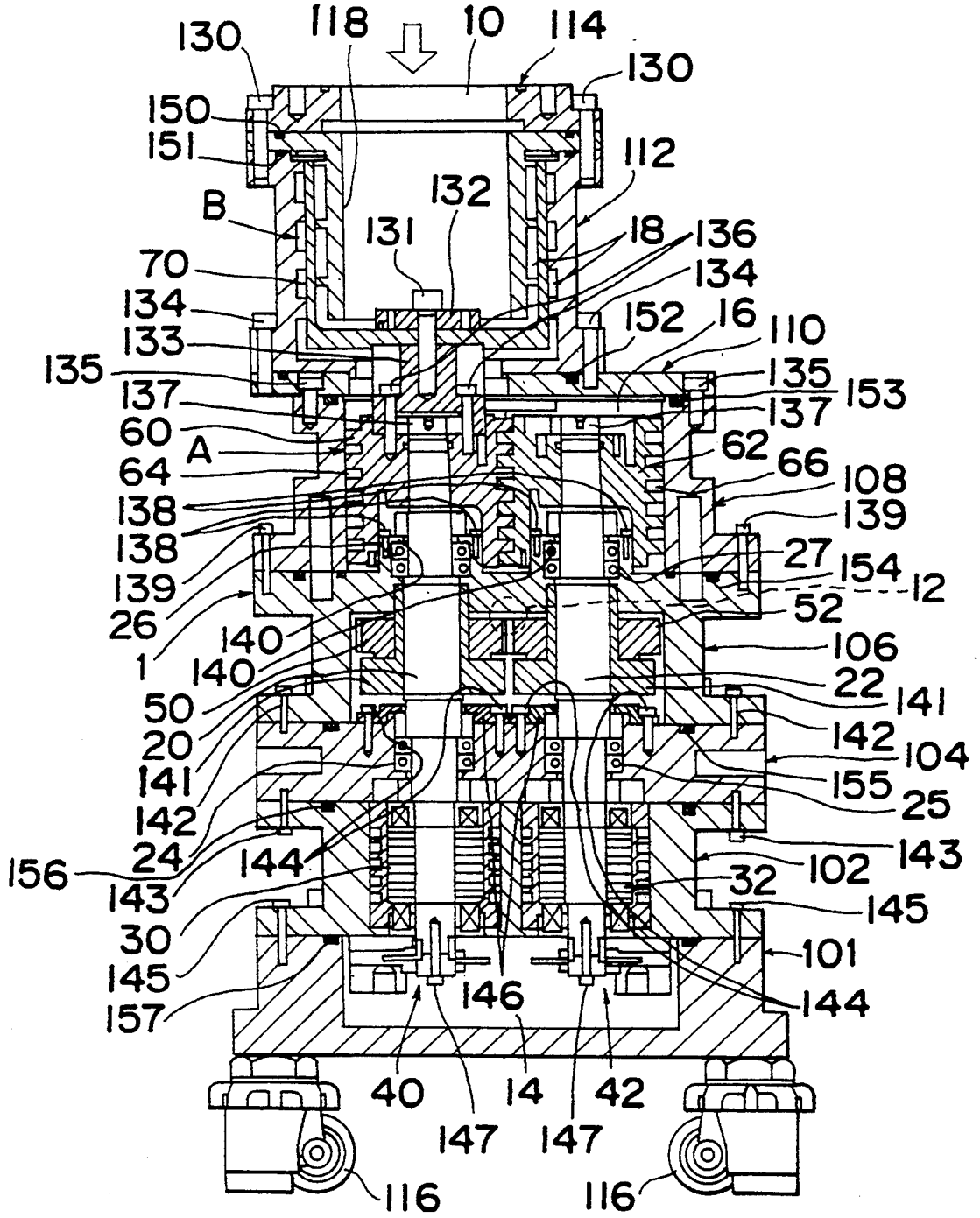
FIG. 1 is a sectional view showing a fluid rotary apparatus according to an embodiment of the present invention.

Before the description of the present invention proceeds, it is to be noted that like parts are designated by like reference numerals throughout the accompanying drawings.

Figure 2:
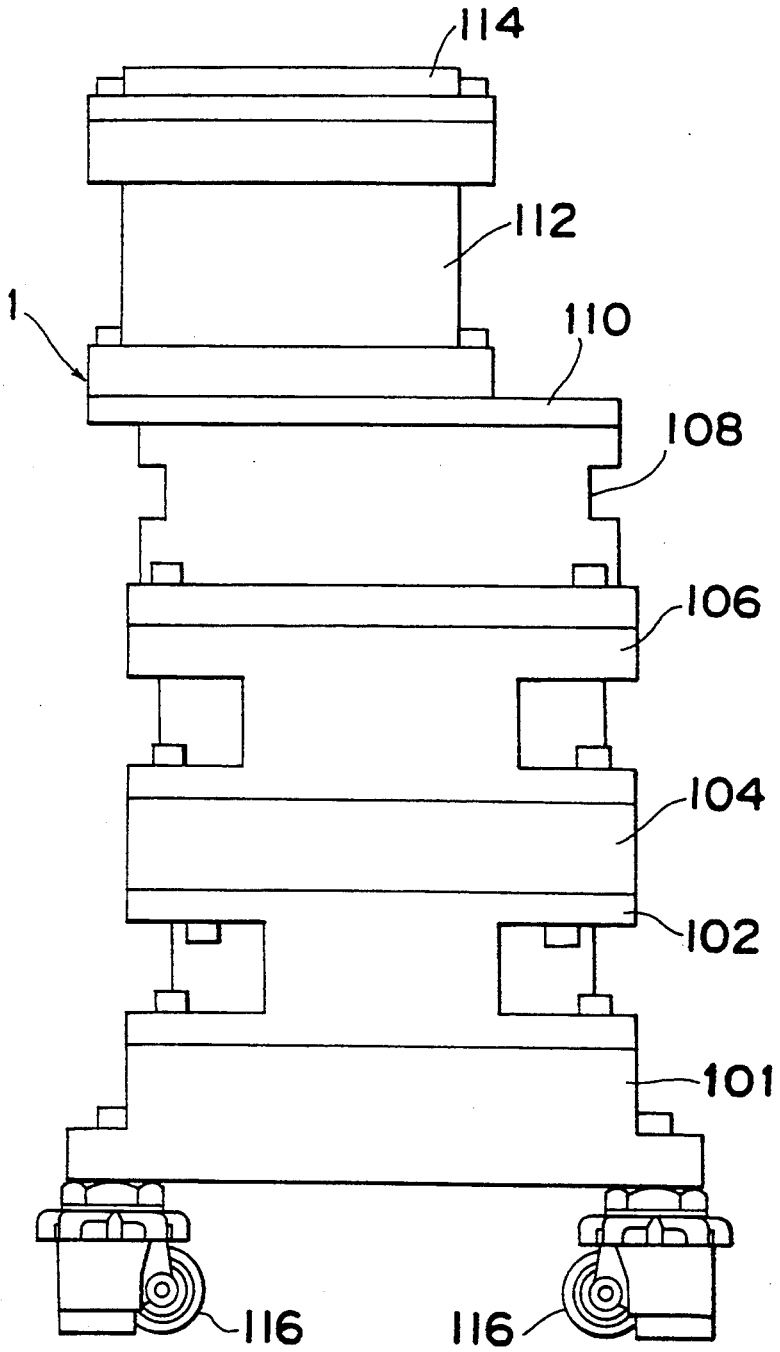
FIG. 2 is a front view showing the fluid rotary apparatus of FIG. 1, but with bolts for connecting separate housing sections omitted.

A vacuum pump, of a fluid rotary apparatus according to the embodiment of the present invention, capable of generating a vacuum environment in a wide range of pressures, will be described below with reference to FIGS. 1 and 2.

The vacuum pump comprises two kinds of pump structure sections, namely, a positive displacement pump structure section (A) disposed in a lower section of a housing 1 and a kinetic pump structure section (B) disposed in an upper section thereof. The kinetic pump structure section (B) inhales fluid, e.g., gas from a suction opening 10 formed in the housing 1. The gas is allowed to pass from the kinetic pump structure section (B) to the positive displacement pump structure section (A). The positive displacement pump structure section (A) discharges the gas from the housing 1 via a fluid-discharging opening 12 formed in the housing 1 such as a housing section 108 or 106 described later.

The construction of the positive displacement pump structure section (A) is described below. Two driving shafts 20 and 22 parallel with each other are vertically disposed in the housing 1. Driving motors 30 and 32 are disposed at lower ends of the shafts 20 and 22, respectively. Rotation detecting encoders 40 and 42 are disposed at the lower ends of the shafts 20 and 22, respectively, so as to output signals therefrom to control the synchronous rotation of the motors 30 and 32. The encoders 40 and 42 are accommodated in an encoder-accommodating chamber 14 of the housing 1. The shafts 20 and 22 are rotatably supported in the housing 1 by each of bearings 24 and 25, such as ball bearings, disposed above the motors 30 and 32, respectively. Contact-preventing gears 50 and 52 are disposed above each of the bearings 24 and 25 and are mounted on each of the shafts 20 and 22, respectively. The shafts 20 and 22 are also supported in the housing 1 by each of bearings 26 and 27, such as ball bearings, disposed above the contact-preventing gears 50 and 52, respectively. Rotors 60 and 62 are disposed above the bearings 20 and 27 and are mounted on the shafts 20 and 22, respectively.

The rotors 60 and 62 are accommodated in a pump chamber 16 of the housing 1. The lower portion of the pump chamber 16 communicates with the discharging opening 12. Rotors 60 and 62 rotate in opposite directions with thread grooves 64 and 66 formed on the peripheral surfaces thereof engaging each other. As a result, the volume in a closed space between the inner wall of the pump chamber 16 and the rotors 60 and 62 changes cyclically. As a result, gas is inhaled from the upper portion of the pump chamber 16 and fed downward, i.e., a pumping operation is performed. The construction of a positive displacement pump of a conventional type, e.g. a screw groove type fluid rotary apparatus, can be applied to that of the rotors 60 and 62 of the positive displacement pump structure section (A).

The contact-preventing gears 50 and 52 are respectively mounted on the shafts 20 and 22 to prevent the rotors 60 and 62 from contacting each other. That is, there is a predetermined backlash gap between the teeth of the contact-preventing gear 50 and the mating teeth of the contact-preventing gear 52, and the contact-preventing gears 50 and 52 do not contact each other when the shafts 20 and 22 are rotating synchronously. If the shafts 20 and 22 are rotating asynchronously, the contact-preventing gears 50 and 52 contact each other before the rotors 60 and 62 contact each other. In this manner, the rotors 60 and 62 can be prevented from being brought into contact with each other or damaged. Accordingly, even though the shafts 20 and 22 do not rotate synchronously, the degree of asynchronous rotation thereof does not exceed the backlash between the teeth of the contact-preventing gear 50 and the mating teeth of the contact-preventing gear 52. In order to attain the above operation, the backlash between the teeth of the contact-preventing gear 50 and the mating teeth of the contact-preventing gear 52 is made to be smaller than that between the thread groove 64 of the rotor 60 and the thread groove 66 of the rotor 62. Preferably, a solid lubricating film is formed on the teeth surfaces of the contact-preventing gears 50 and 52 so as to reduce the friction therebetween.

The encoders 40 and 42 detect the rotational speed of each of the shafts 20 and 22, the rotational position thereof or the rotational angle thereof. The motors 30 and 32 are controlled based on the information of the detected rotational speed of the shafts 20 and 22 and the information of the rotational position thereof so that the shafts 20 and 22 rotate synchronously. Methods for synchronously rotating a plurality of shafts of conventional rotation-driving apparatuses can be applied to the method for controlling the motors 30 and 32 based on the construction of the encoders 40 and 42 and the information detected thereby. Preferably, the information is transmitted from the encoders 40 and 42 to a control device via an optical cable so as to prevent an erroneous transmission of the information due to electrical noise or nonreliable control for synchronously rotating the shafts 20 and 22.

It is necessary to prevent foreign matter such as dust from penetrating into the encoder-accommodating chamber 14 so that the encoders 40 and 42 can reliably operate. To this end, it is effective to provide a magnetic fluid seal at a boundary between the encoder-accommodating chamber 14 and a space disposed above the chamber through which the shafts 20 and 22 penetrate. In addition, it is preferable to provide a gas purge means for pressurizing the encoder-accommodating chamber 14 at a constant pressure by nitrogen gas. The magnetic fluid seal and the gas purge means are provided between the pump chamber 16 and the bearings 26 and 27 disposed below the pump chamber 16 and between the pump chamber 16 and the motors 30 and 32 so as to effectively prevent corrosive gas from penetrating into the fluid rotary apparatus.

The kinetic pump structure section (B) disposed above the positive displacement pump structure section (A) will be described below.

The shaft 20 extends upward from the pump chamber 16 of the positive displacement pump structure section (A). A cylindrical rotor 70 is mounted on the upper end of the shaft 20. The rotor 70 is accommodated between the inner wall of a housing section 112 of the housing 1 and a cylindrical inner partitioning wall 118 integrally connected with the housing 1 together with a housing section 114 by bolts 130. Thread grooves are formed on the inner wall of the housing section 112 of the housing 1 and the outer surface of the inner partitioning wall 118, respectively. A pumping space 18 is formed between the outer surface of the rotor 70 and the inner wall of the housing section 112 and between the inner surface of the rotor 70 and the outer surface of the inner partitioning wall 118. Due to the rotation of the rotor 70, fluid such as gas sucked from the suction opening 10 is fed upward through the space between the thread groove formed on the outer surface of the inner partitioning wall 118 and the rotor 70 and then fed downward through the space between the rotor 70 and the thread groove formed on the inner wall of the housing section 112. That is, according to this construction, the rotor 70 imparts momentum to gas molecules in contact with the rotor 70 due to its rotation, thus performing the gas discharge action and the pumping action thereof. A great momentum can be imparted to the gas for a long period of time by causing the gas to flow between the inner side of the rotor 70 and the outer side thereof repeatedly. As a result, the kinetic pump structure section (B) has a high pumping performance. Since the pumping space 18 communicates with the pump chamber 16 of the positive displacement pump structure section (A), gas discharged from the kinetic pump structure (B) is fed to the positive displacement pump structure section (A).

In addition to the above-described construction, the constructions of kinetic pumps provided in conventional fluid rotary apparatuses can be applied to the construction of the kinetic pump structure section (B).

The construction of the housing 1 accommodating the positive displacement pump structure section (A) of the fluid rotary apparatus and the kinetic pump structure section (B) thereof is described below.

The housing 1 comprises a plurality of block-shaped housing section 101, 102, 104, 106, 108, 110, 112 and 114 layered one on the other. The lowermost housing section 101 forms the encoder-accommodating chamber 14, and is provided with a pair of casters 116 for moving the entire apparatus, disposed at the lower end thereof. The housing section 102 adjacent to the housing section 101 accommodates the motors 30 and 32. The housing section 104 accommodates the bearings 24 and 25. The housing section 106 accommodates the contact-preventing gears 50 and 52. The housing section 108 accommodates the rotors 60 and 62 and forms the pump chamber 16. The housing section 110 closes the upper end of the pump chamber 16 and forms a fluid path from the kinetic pump structure section (B) to the positive displacement pump structure section (A). The driving shaft 20 extends upward through the housing section 110. The housing section 112 accommodates the rotor 70 of the kinetic pump structure section (B). The thread groove is formed on the inner surface of the housing section 112. The housing section 114 is installed on the housing section 112 with the inner partitioning wall 118 sandwiched therebetween, thus forming the suction opening 10. The housing sections 101 through 114 have horizontal surfaces which are connected with each other by bolts 130, 134, 135, 139, 141, 143 and 145. That is, the housing sections 114, 118 and 112 are connected with each other by the bolts 130 with sealing members 150 and 151, such as O-rings, sandwiched between them. The housing sections 112 and 110 are connected with each other by the bolts 134 with a sealing member 152, such as an O-ring, sandwiched between them. The housing sections 110 and 108 are connected with each other by the bolts 135 with a sealing member 153, such as an O-ring, sandwiched between then. The housing sections 108 and 106 are connected with each other by the bolts 139 with a sealing member 154, such as an O-ring, sandwiched between them. The housing sections 106 and 104 are connected with each other by the bolts 142 with a sealing member 155, such as an O-ring, sandwiched between them. The housing sections 104 and 102 are connected with each other by the bolts 143 with a sealing member 156, such an O-ring, sandwiched between them. The housing sections 102 and 101 are connected with each other by the bolts 145 with a sealing member 157, such as an O-ring, sandwiched between them.

In assembling the housing 1, the housing sections 101 through 114 are layered one on top of the other in order from the lower section to the upper section. The shafts 20 and 22 are disposed in each of the housing sections 101 through 114, and the components such as the encoders 40 and 42 and the motors 30 and 32 are mounted in the housing sections 101 through 114 at predetermined positions thereof. In disassembling the housing 1, the housing sections 101 through 114 are removed in order from the upper section to the lower section and the components are also removed. This disassembling operation is described below in detail. First, when starting from an assembled condition as in FIG. 1, the bolts 130 are removed to remove the housing sections 114 and 118 from the housing section 112. A bolt 131 is removed to remove a bracket 132 for fixing the rotor 70 to a bracket 133 fixed onto the rotor 60. Then, the rotor 70 is removed. The bolts 134 are removed to remove the housing section 112 from the housing section 110. The bolts 135 and bolts 136 are removed. The bracket 133 is removed from the upper of the rotor 60. A nut 137 screwed on the upper end of the driving shaft 22 is removed to remove the rotor 62 from the driving shaft 22. A nut 137 screwed on the upper end of the driving shaft 20 is removed to remove the rotor 64 from the driving shaft 20. The bolts 139 are removed to remove the housing section 108 from the housing section 106. Bolts 138 are removed to remove rings 140 for fixing the bearings 26 and 27 to the housing section 106. The bolts 142 are removed to remove the housing section 106 from the housing section 104. The contact-preventing gears 50 and 52 and brackets 141 for fixing the gears 50 and 52 to the driving shafts 20 and 22 are removed from the driving shafts 20 and 22. Bolts 144 and rings 146 for fixing the bearings 24 and 25 to the housing section 104 are removed. The bolts 143 are removed. On the other hand, the bolts 145 are removed to remove the housing section 101 from the housing section 102. Bolts 147 for fixing the encoders 40 and 42 to the driving shafts 20 and 22 are removed to remove the encoders 40 and 42 from the driving shafts 20 and 22. Then, the driving shafts 20 and 22 are removed from the housing sections 102 and 104. The bearings 24 and 25 are removed from the housing section 104. The housing section 104 is removed from the housing sections 102. The motors 30 and 32 are removed from the housing section 102. It is possible to assemble the housing 1 in the order from an intermediate housing section upward to the upper housing sections and downward to the lower housing sections.

In this embodiment, the components can be incorporated in the housing sections 101 through 114 easily and accurately while the housing sections 101 through 114 are sequentially connected with each other. Thus, the fluid rotary apparatus can be assembled very easily. In particular, since each component, such as the encoders 40 and 42 and the motors 30 and 32, is accommodated in each of the housing sections 101 through 114, the positions of each component and the housing sections 101 through 114 can be adjusted with a high accuracy. That is, the housing 1 can be assembled with efficiency and accuracy.

The housing 1 may comprise a varied number of housing sections and the lengths of the housing sections may be varied.

According to this embodiment, the fluid rotary apparatus is used with the positive displacement pump structure section (A) and the kinetic pump structure section (B) connected with each other, but the positive displacement pump structure section (A) may be used independently.

Figure 3:
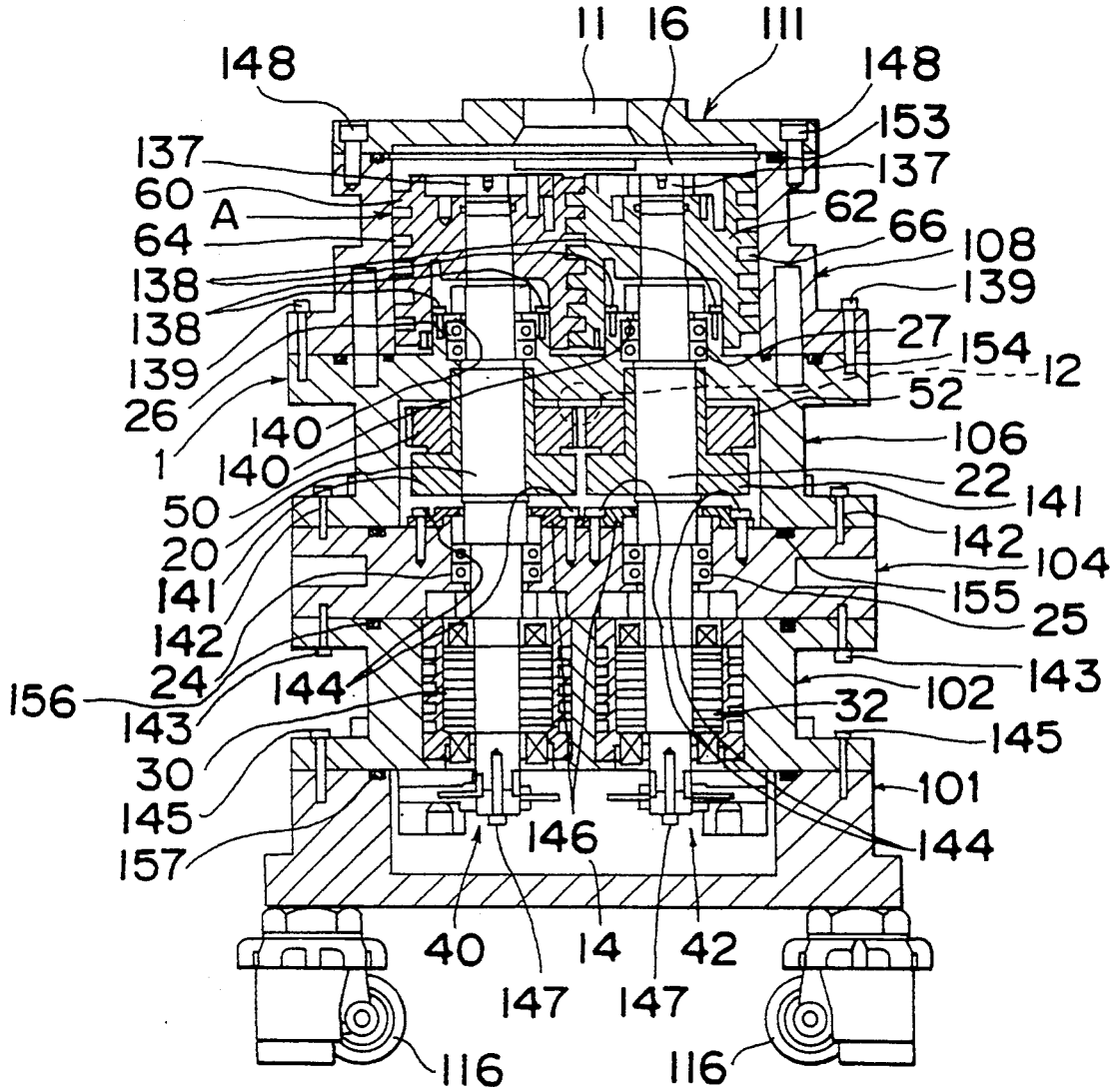
FIG. 3 is a sectional view showing the fluid rotary apparatus of FIG. 1 from which a kinetic pump structure section has been removed.

As show in FIG. 3, the rotor 70 of the kinetic pump structure section (B) is removed from the upper end of the shaft 20, and the housing section 110 is also removed from the housing section 108 forming the pump chamber 16 of the positive displacement pump structure section (A). A housing section 111 having a suction opening 11 formed therethrough in the center thereof is installed on the upper end of the housing section 108 by bolts 148, with the sealing member 153 sandwiched between them, so that the positive displacement pump structure section (A) discharges fluid sucked from the suction opening 11 from the discharging opening 12. This construction is effective for efficiently performing a vacuum environment generating operation which does not require a high vacuum, such as a roughing operation.

Figure 4:
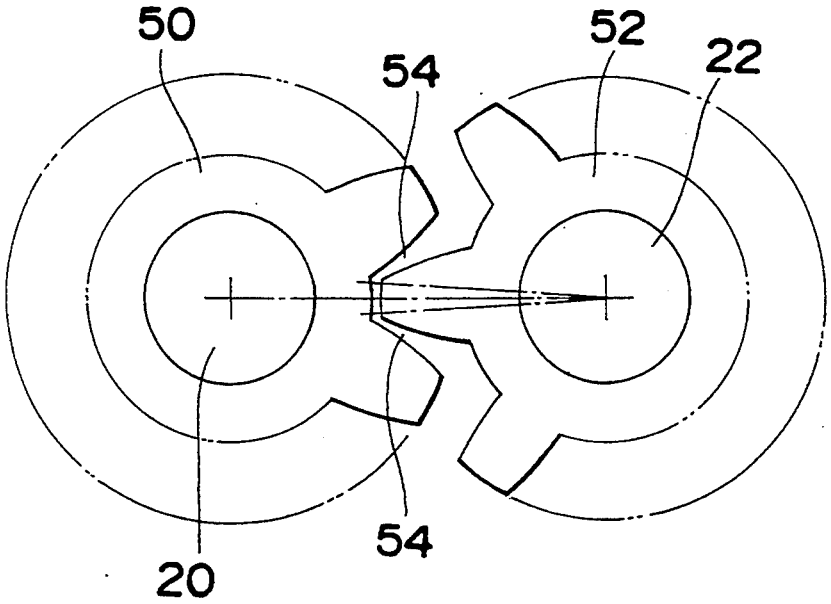
FIG. 4 is a schematic view showing backlash between contact-preventing gears.

The method for adjusting the backlash between the contact-preventing gears 50 and 52 of the positive displacement pump structure section (A) is described below with reference to FIGS. 4 and 5.

It is necessary to operate the contact-preventing gears 50 and 52 with a uniform backlash 54 formed on both sides of each mating tooth space of respective gear 50 and 52 so that the teeth of the contact-preventing gear 50 do not contact the mating teeth of the contact-preventing gear 52. If the backlash 54 on one side is greater than the backlash 54 on the other side, i.e., if the backlash 54 on one side is greater than the backlash between the gears of the rotors 60 and 62, the following problem occurs when the shafts 20 and 22 do not rotate synchronously. That is, the rotors 60 and 62 contact each other before the teeth of the contact-preventing gear 50 and the mating teeth of the contact-preventing gear 52 contact each other. As a result, the rotors 60 and 62 are damaged or do not rotate correctly. In operating the fluid rotary apparatus, however, it is difficult to adjust the lengths of the backlashes 54 between the contact-preventing gears 50 and 52 because they are incorporated inside the apparatus. Therefore, the following method is adopted in this embodiment.

Figure 5:
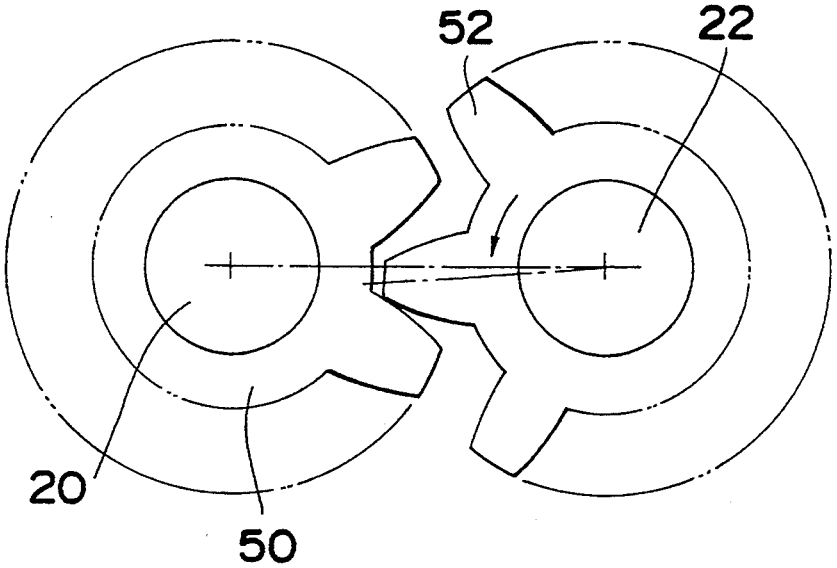
FIGS. 5(*a*) and 5(*b*) are explanatory views showing a method for adjusting the backlash between the contact-preventing gears.
Figure 5:
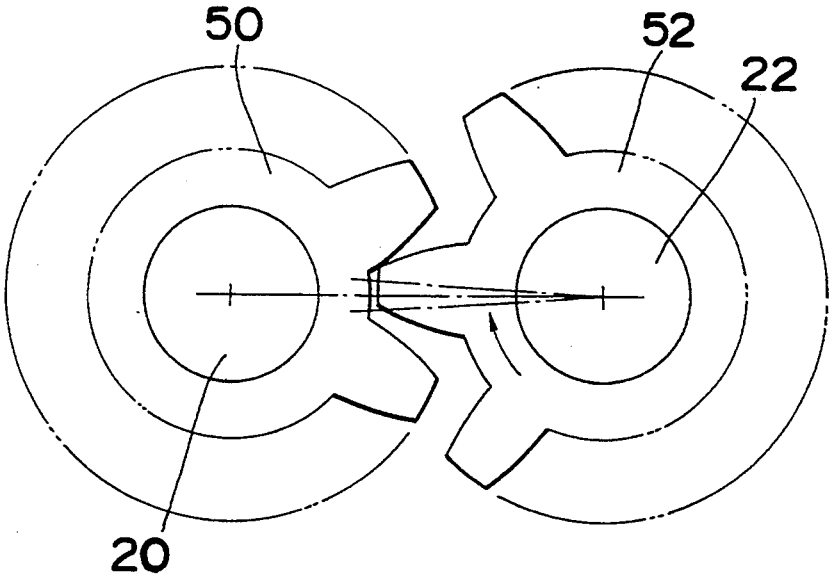
Figure 6:
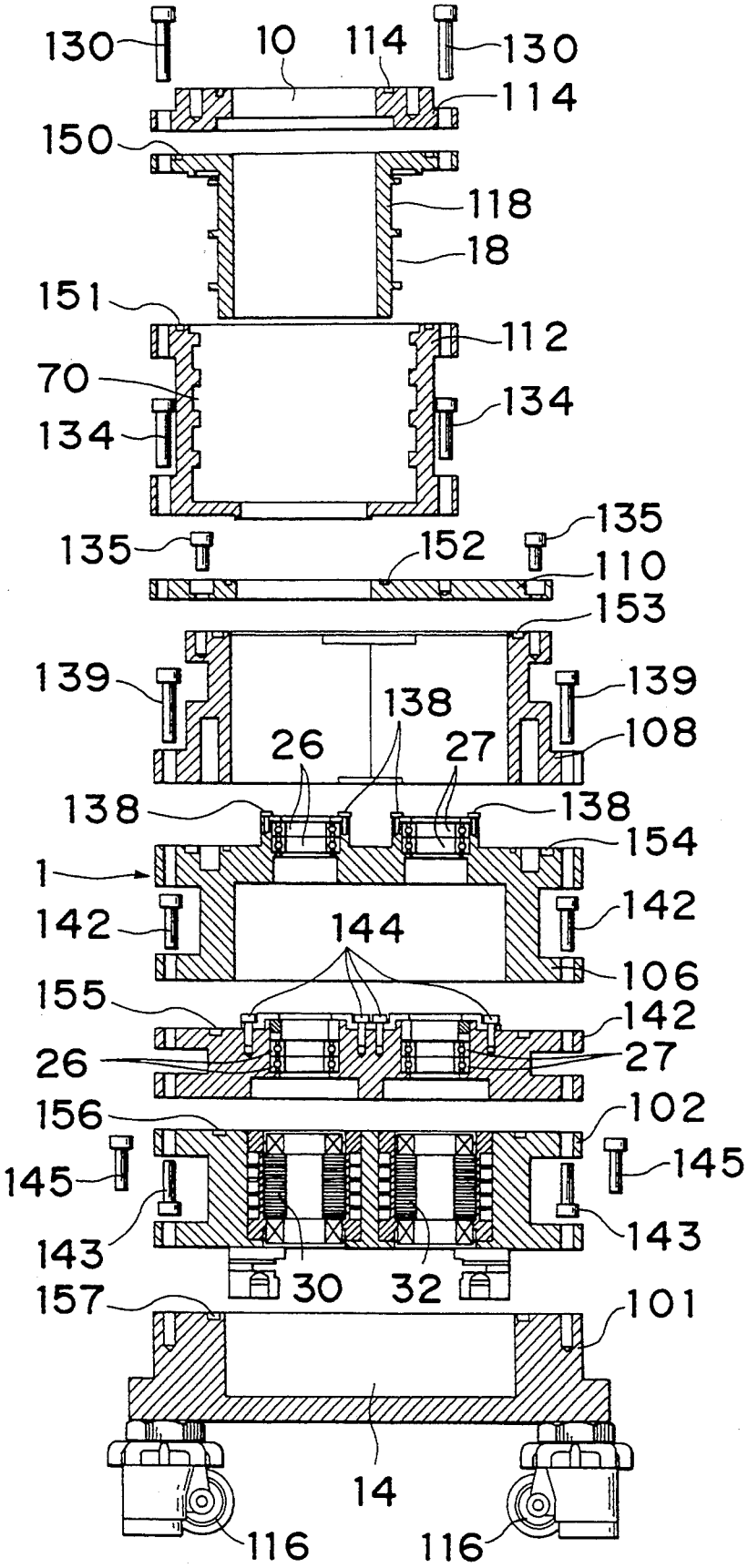
FIG. 6 is an exploded sectional view of portions of the apparatus shown in FIG. 1.
Figure 7:
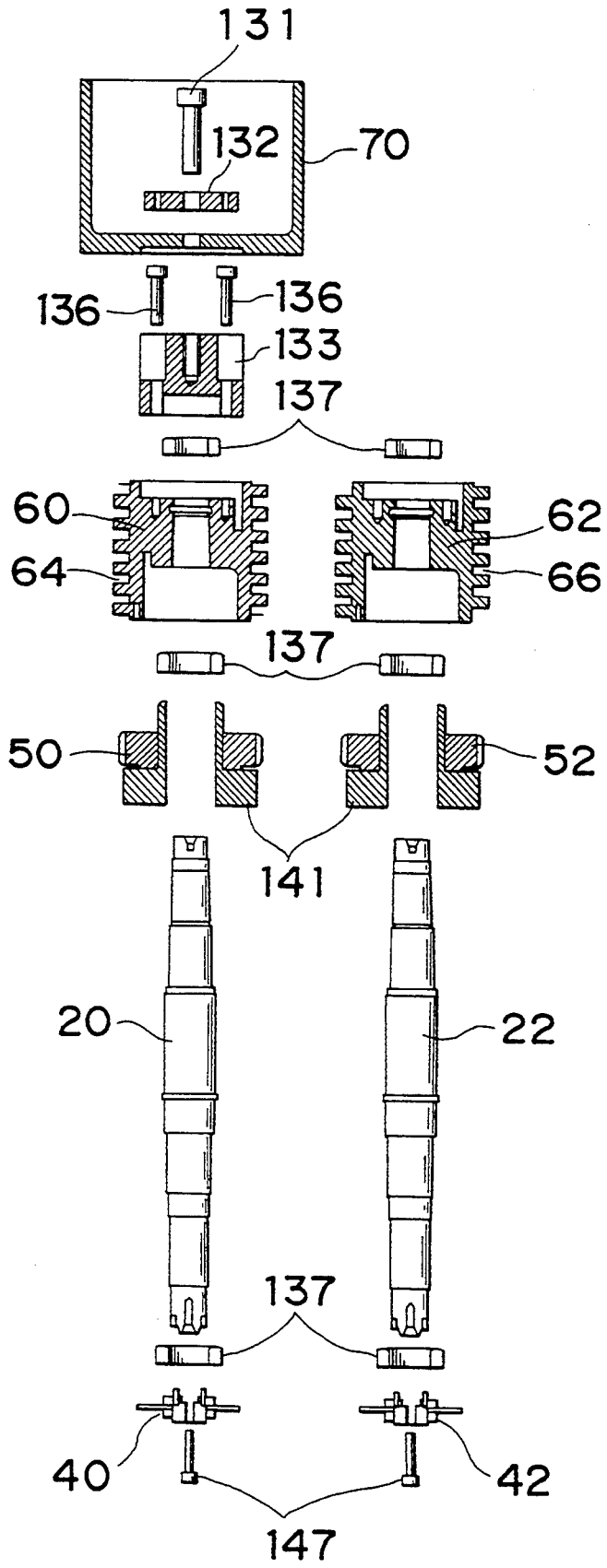
FIG. 7 is an exploded sectional view of portions of the apparatus shown in FIG. 1.

As shown in FIG. 5(*a*), the contact-preventing gear 52 is rotated counterclockwise until a tooth thereof is brought into contact with a tooth of the contact-preventing gear 50, which is kept stationary. At this time, the rotational position of the contact-preventing gear 52 is detected by the encoder 42 and stored. Then, as show in FIG. 5(*b*), the contact-preventing gear 52 is rotated clockwise until the tooth thereof is brought into contact with an adjacent tooth of the contact-preventing gear 50. At this time, the rotational position of the contact-preventing gear 52 is detected by the encoder 42 and stored. Then, the contact-preventing gear 52 is rotated counterclockwise until the tooth thereof is at the position intermediate between the rotational position shown in FIG. 5(*b*) and that shown in FIG. 5(*a*) so that the tooth of the contact-preventing gear 52 is located as shown in FIG. 4. In this manner, the extent of the backlash 54 of the contact-preventing gear 52 on one side thereof is equal to that of the backlash 54 thereof on the other side. In operating the fluid rotary apparatus in this condition, the contact-preventing gears 50 and 52 are capable of effectively preventing the rotors 60 and 62 from contacting each other.

The backlash between the contact-preventing gears 50 and 52 can be automatically adjusted by a control program provided in the fluid rotary apparatus.

As apparent from the foregoing description, the housing comprises a plurality of housing sections layered one on the other in the axial direction of one of the driving shafts. Therefore, the fluid rotary apparatus can be assembled and disassembled very easily and efficiently, and in addition, the maintenance and control thereof can be easily accomplished.

The housing accommodates the positive displacement pump structure section and the kinetic pump structure section. Accordingly, the fluid rotary apparatus is capable of generating a high vacuum from a low vacuum generated in a roughing operation. Consequently, the apparatus is compact and capable of accomplishing composite processing in a multi-chamber and in addition, the equipment for generating a vacuum environment can be simplified and manufactured at a low cost.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A vacuum pump, comprising:

a housing having a fluid suction opening and a fluid discharge opening therein;

a plurality of driving shafts extending axially in said housing, said shafts having upper and lower portions;

a plurality of positive displacement rotors mounted on said driving shafts;

a plurality of upper and lower bearings rotatably supporting said upper and lower portions of said driving shafts;

a plurality of motors connected with said driving shafts and adapted to independently and synchronously drive said driving shafts;

a plurality of rotation detectors mounted on said driving shafts detecting one of the rotational angle and the number of rotations of said motors; and contact-preventing gears mounted on said driving shafts rotatable with said rotors for contacting each other before contact between said rotors;

wherein a positive displacement pump structure section is defined in said housing and includes a space defined by said positive displacement rotors and said housing;

a kinetic pump structure section defined in said housing coaxial with one of said driving shafts and above said positive displacement pump structure section, said kinetic pump structure section having a kinetic pump rotor for imparting momentum to gas molecules by rotation of said kinetic pump rotor; and wherein said housing comprises, in the axial direction of said driving shafts:

a first housing section housing and covering said rotors over the axial extent thereof;

a second housing section removably fixed to said first housing section and housing and covering said contact-preventing gears and said upper bearings, said upper bearings being fixedly mounted in said second housing section;

a third housing section removably fixed to said second housing section housing and covering said lower bearings, said lower bearings being fixedly mounted in said third housing section;

a fourth housing section removably fixed to said third housing section housing and covering said motors over the axial extent thereof;

a fifth housing section removably fixed to said fourth housing section housing and covering said rotation detectors;

a sixth housing section housing said kinetic pump structure section;

fixing members removably fixing said housing sections to each other so that said sixth housing section can be removed from the other said housing sections; and sealing members held between adjacent said housing sections.

2. The vacuum pump of claim 1, wherein said rotor of said kinetic pump structure section is cylindrical and fixed to said one of said driving shafts, said sixth housing section has a cylindrical projection connected thereto and disposed in said rotor such that said rotor has an outer wall opposite an inner wall of said sixth housing section and said rotor has an inner wall opposite an outer wall of said cylindrical projection, a groove is formed between one of said outer wall of said rotor and said inner wall of said sixth housing, and said inner wall of said rotor and said outer wall of said cylindrical projection, and said kinetic pump structure section has a downstream side connected to an upstream side of said positive displacement pump structure section.

3. The vacuum pump of claim 1, wherein said fluid suction opening is in said first housing section, and said fluid discharge opening is in one of said first and second housing sections.

4. The vacuum pump of claim 1, wherein each said rotor of said positive displacement pump structure section has a peripheral surface with one of a helical groove and a helical projection thereon.

5. The vacuum pump of claim 1, wherein there is an amount of backlash between said contact preventing gears and an amount of backlash between said rotors, and the amount of backlash between said contact preventing gears is smaller than the amount of backlash between said rotors.

6. The vacuum pump of claim 1, wherein said bearings are ball bearings.

7. The vacuum pump of claim 1, wherein said rotation detectors include encoders.

8. The vacuum pump of claim 1, wherein said housing has a pair of casters thereon at a lower end thereof.

9. A vacuum pump comprising:

a housing having a fluid suction opening and a fluid discharge opening;

a plurality of driving shafts extending in said housing, said shafts having upper and lower portions;

a plurality of positive displacement rotors mounted on said driving shafts in said housing;

a plurality of upper and lower bearings rotatably supporting said upper and lower portions of said driving shafts in said housing;

a plurality of motors connected with said driving shafts and adapted to independently and synchronously drive said driving shafts;

a plurality of rotation detectors mounted on said driving shafts detecting one of the rotational angle and the number of rotations of said motors; and contact-preventing gears on said driving shafts rotatable with said rotors for contacting each other before contact between said rotors;

wherein a positive displacement pump structure section is defined in said housing and includes a space defined by said positive displacement rotors and said housing;

wherein a kinetic pump structure section is defined in said housing coaxial with one of said driving shafts and above and upstream of said positive displacement pump structure section, said kinetic pump structure section having a kinetic pump rotor adapted to impart momentum to gas molecules by rotation of said rotor; and wherein said housing comprises, in the axial direction of said driving shafts:

a first housing section housing and axially covering said rotors;

a second housing section housing and axially covering said motors;

a third housing section housing and axially covering said kinetic pump structure section;

fixing members removably fixing said housing sections to each other so that said first through third housing sections can be disassembled and so that said third housing section can be removed from the other said housing sections; and sealing members held between adjacent said housing sections;

wherein said housing further comprises a fourth housing section housing and covering said rotation detector, said fourth housing section being disassembleable from the other said housing sections.

10. The vacuum pump of claim 9, and further comprising a gas purge means for pressurizing an inner chamber of said housing at a constant pressure by providing nitrogen gas in said inner chamber of said housing, thereby preventing corrosive gases from penetrating into said housing.

* * * * *